United States Patent [19]

Greer

[11] 3,938,202

[45] Feb. 17, 1976

[54] ASSEMBLY FOR CLEANING OVERFLOW PASSAGEWAY IN LAVATORY BOWL

[76] Inventor: Lucian F. Greer, 1700 N. H St., Midland, Tex. 79701

[22] Filed: Aug. 22, 1974

[21] Appl. No.: 499,849

[52] U.S. Cl. ..... 4/255
[51] Int. Cl.[2] ..... E03D 11/00
[58] Field of Search ..... 4/1, 255–257; 134/22 R

[56] References Cited

UNITED STATES PATENTS 3,480,021 11/1969 Ewald ..... 4/255

*Primary Examiner*—Houston S. Bell, Jr.
*Attorney, Agent, or Firm*—Clarence A. O'Brien; Harvey B. Jacobson

[57] ABSTRACT

A cup-like shield formed of resiliently flexible material is mounted on one end of an elongated adjustable rod. The shield is positionable about the inlet of an overflow passage in a lavatory bowl and locked into sealed relation with the bowl by means of the adjustable rod engaging, through a cushioned second end, the opposite wall of the bowl. The shield opens upwardly for the introduction of liquid and laterally for discharge of the liquid into the passage inlet.

10 Claims, 2 Drawing Figures

ASSEMBLY FOR CLEANING OVERFLOW PASSAGEWAY IN LAVATORY BOWL

The invention herein is generally concerned with plumbing apparatus, and more specifically relates to a unique device for enabling the simplified cleaning of the overflow passage or passageway in a lavatory bowl.

More specifically, the device of the invention provides a cup-like receiver or funnel about the inlet of an overflow passage so as to enable the pouring of a cleaning solution, disinfectant or the like into the upper end of the overflow tube. In connection therewith, an elongated plug is provided for insertion into the drain hole of the bowl in a manner so as to seal the discharge end of the overflow passage for a trapping of the cleaning solution or the like therein for such time as is deemed necessary so as to clean and disinfect the passage.

Such a device will enable the homeowner to maintain the overflow passage free of filth, bacteria and the like in a simple yet highly effective manner utilizing easily manipulated and substantially trouble free components.

Basically, the assembly consists of an elastomeric cup-like shield which engages about the inlet of an overflow passage and is retained in position by means of an elongated adjustable rod. When so positioned, liquid can be easily poured through the open top of the shield for lateral discharge into the overflow inlet. The liquid is retained for the necessary period of time within the overflow passage by an appropriate plug inserted within the bowl drain.

The inventor is aware of the following prior art U.S. Pat. Nos. which are not deemed anticipatory of the invention:

| | |
|---|---|
| 216,006 issued May 27, 1879 | 239,667 issued April 5, 1881 |
| 299,476 issued May 27, 1884 | 321,973 issued July 14, 1888 |
| 302,253 issued July 22, 1884 | 379,973 issued March 27, 1888 |
| 302,269 issued July 27, 1884 | |

These together with other objects and advantages which will become subsequently apparent reside in the details of constructon and operation as more fully hereinafter described and claimed, reference being had to the accompanying drawings forming a part hereof, wherein like numerals refer to like parts throughout.

Figure 1:
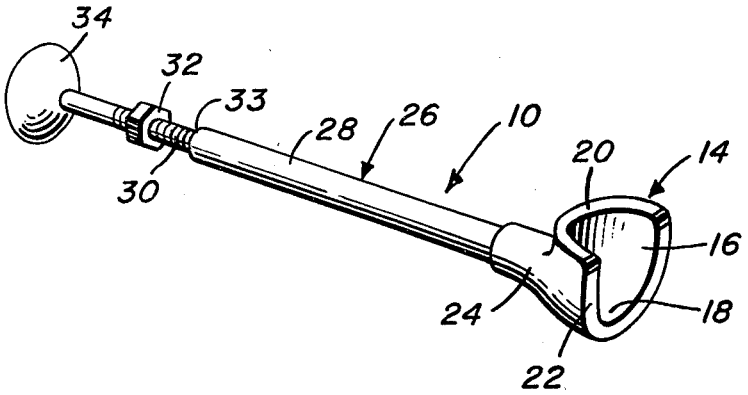
Figure 2:
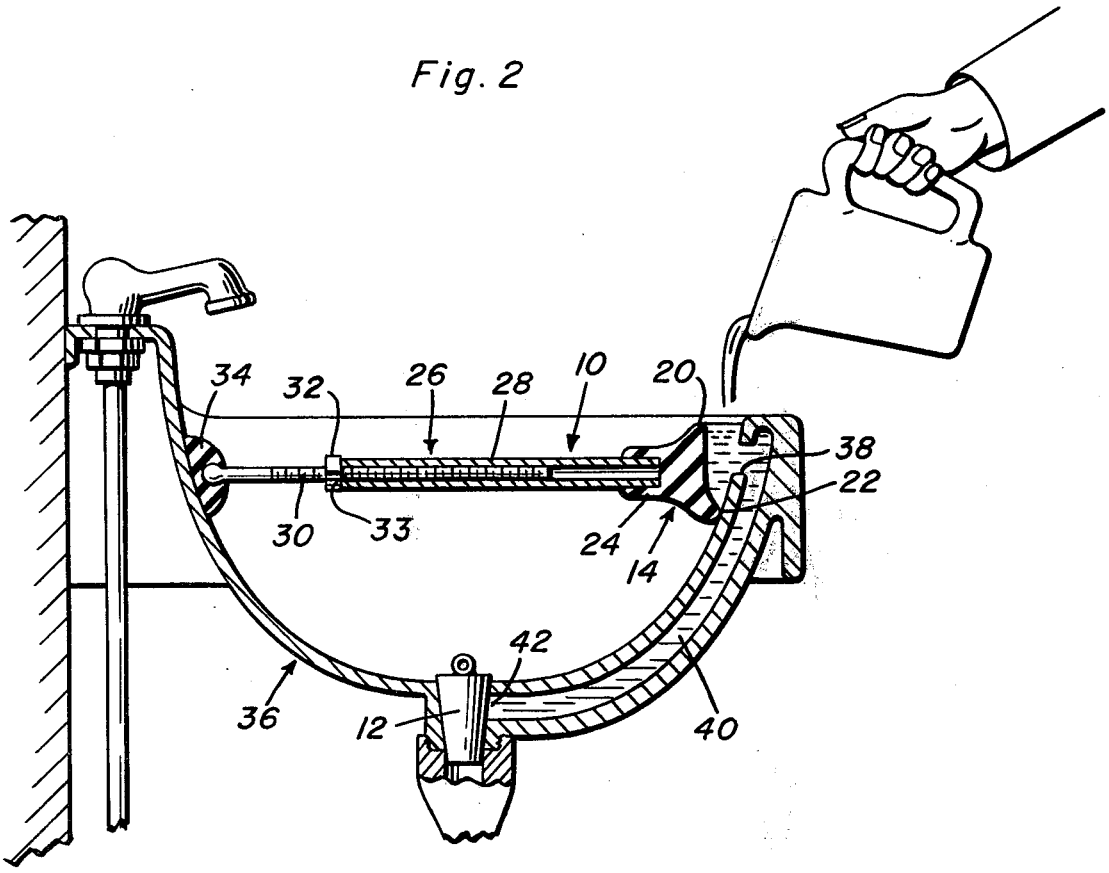

FIG. 1 is a perspective view of the liquid directing device of the invention; and FIG. 2 is a cross-sectional detail through a lavatory bowl with the assembly of the present invention installed therein and liquid being introduced to the overflow passage.

Referring now more specifically to the drawings, the assembly for cleaning the overflow passage in a lavatory bowl consists of two basic components, the liquid introducing device 10 and the elongated drain received plug 12.

The device 10 includes a cup-like shield or funneling element 14 formed of an appropriate water resistant flexibly resilient or elastomeric material. The shield 14 is basically in the shape of half a cup, including a vertical arcuate wall 16, a rounded bottom 18, a semi-circular top edge 20 and a U-shaped vertical front edge 22.

The shield 14 also includes a solid rearwardly directed rear portion 24 which is telescoped over and frictionally affixed to the forward end of an elongated longitudinally adjustable rod 26. While the rod 26 can be longitudinally adjusted in any of several appropriate manners, in the illustrated example, the rod 26 includes a hollow portion 28 which receives an externally threaded portion 30 therein for adjustment therealong. An appropriate adjusting nut 32 is threaded on portion 30 for abutment against the end 33 thereof so as to exert an outward pressure on the portions 28 and 30 to fix the rod 26 in position. The second or remote end of the adjustable rod 26 mounts an appropriate elastomeric cushion 34 so as to provide a non-slip cushioned engagement with the lavatory bowl herein designated by reference numeral 36.

In use, the vertical edge 22 of the shield 14 is placed against the front wall of the lavatory 36 so as to engage the wall both to the opposite sides and below the inlet 38 of the overflow passage or passageway 40. The rod 26 is then appropriately extended to engage the cushion 34 against the rear wall of the lavatory 36 with such force being exerted as to deform the cup-like shield 14 in intimate contact with the lavatory wall about the inlet 38. The arcuate upper edge 20 of the shield forms a liquid receiving opening for the introduction of appropriate cleaning solutions, disinfectants or the like, as suggested in FIG. 2, which liquid discharges laterally into the overflow passage 40.

The elongated plug 12 is of particular significance in that the plug is of a size and configuration so as to seal the discharge end 42 of the overflow passage 40 for a retention of the liquid therein a length of time sufficient so as to achieve the desired results. Subsequent to the cleaning procedure, the plug 12 is removed, allowing the liquid to drain from the overflow passage, the rod 26 contracted and the unit or component 10 removed.

There has thus been described a simple although highly unique means for effectively cleaning the overflow passage of a lavatory bowl or the like. The entire assembly can be both easily mounted and removed and can be simply and effectively utilized by the homeowner in the performance of what is normally a difficult job.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An assembly for cleaning the overflow passage in a lavatory bowl comprising a liquid directing cup-like shield and means for fixing said shield about the inlet to the overflow passage adjacent the upper edge of a lavatory bowl, said shield including an upwardly opening liquid receiving portion and a laterally directed liquid discharging portion for lateral discharge of liquid into an overflow passage inlet.

2. The assembly of claim 1 wherein said shield includes a forward generally U-shaped edge engageable about the overflow inlet to the opposite sides and below the inlet and defining the discharge portion.

3. The assembly of claim 2 wherein said shield is of an elastomeric material flexibly deformable to closely conform to the bowl about the inlet.

4. The assembly of claim 3 including separate plug means for closing the lower discharge end of an overflow passage.

5. The assembly of claim 4 wherein the means for fixing the shield about the inlet comprises an elongated adjustable rod, said shield being mounted on one end of the rod with the rod projecting therefrom for engagement with the opposite portion of a lavatory bowl.

6. The assembly of claim 5 including a cushioning member on the second end of said rod.

7. The assembly of claim 1 wherein said upwardly opening liquid receiving portion is defined by a generally horizontally disposed upper edge on said shield, said liquid discharging portion being defined by a generally vertically disposed side edge engaged with the surface of the bowl in at least partial enclosed relation to the overflow passage inlet, adjustable means extending from said shield and engaging the lavatory bowl in opposed relation to the overflow passage inlet to retain the shield in place, and a stopper for the lavatory drain opening and the overflow passage outlet to enable liquid to be poured into the open upper end of the shield and laterally discharged into the overflow passage and retained therein by the stopper until removed.

8. In combination with a lavatory bowl having a bottom drain opening and an overflow passage extending from an inlet adjacent the top inner edge of the bowl to an outlet in the drain opening, a plug for selectively closing the outlet, and a liquid funneling element for introducing liquid into the inlet, said funneling element comprising a hollow member having an open top lateral opening in communication with the inlet for discharging liquid into the inlet and filling the overflow passage.

9. The combination of claim 8 wherein said hollow member includes a laterally extending retaining member in opposed relation to the lateral opening and extending transversely of the bowl with the remote end engaging the bowl and retaining the hollow member in contact with the inner surface of the bowl.

10. The combination of claim 9 wherein said hollow member is constructed of resilient material, said lateral opening being defined by a generally vertically disposed free edge on the hollow member retained in sealing contact with the interior surface of the bowl and maintaining liquid communication between the hollow member and the inlet, said retaining member being longitudinally adjustable and provided with a resilient pad on the end thereof remote from the resilient hollow member.

* * * * *